US008013791B1

(12) United States Patent
Weber et al.

(10) Patent No.: US 8,013,791 B1
(45) Date of Patent: Sep. 6, 2011

(54) PHASED ARRAY SYSTEM USING BASEBAND PHASE SHIFTING

(75) Inventors: Robert J. Weber, Boone, IA (US); Shannon Wanner, Ames, IA (US); Hsin-Jan Fu, Ames, IA (US); Saalini Sekar, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 184 days.

(21) Appl. No.: 12/182,678

(22) Filed: Jul. 30, 2008

(51) Int. Cl.
*H01Q 3/30* (2006.01)

(52) U.S. Cl. ..... 342/372

(58) Field of Classification Search ..... 342/157, 342/368, 372, 373; 455/276.1
See application file for complete search history.

(56) References Cited

U.S. PATENT DOCUMENTS 4,809,005 A * 2/1989 Counselman, III ..... 342/352
5,585,803 A * 12/1996 Miura et al. ..... 342/372
6,380,908 B1 4/2002 Andrews et al.
7,183,971 B1 * 2/2007 Lloyd et al. ..... 342/357.09
2006/0121869 A1 * 6/2006 Natarajan et al. ..... 455/276.1
2007/0160168 A1 * 7/2007 Beukema et al. ..... 375/326

OTHER PUBLICATIONS

Haynes, Toby, "A Primer on Digital Beamforming", Spectrum Signal Processing, hhtp://www.spectrumsignal.com, Mar. 26, 1998, pp. 1-15.
Krim, Hamid et al., "Two Decades of Array Signal Processing Research", IEEE Signal Processing Magazine, Jul. 1996, pp. 67-94.
Wanner, Shannon et al., "Phased Array System Design and Modeling", IEEE 1-4244-1449-0/07, Jul. 30, 2007, pp. 455-458.

* cited by examiner

*Primary Examiner* — Dao L Phan
(74) *Attorney, Agent, or Firm* — McKee, Voorhees & Sease, P.L.C.

(57) ABSTRACT

A method of spatial control of a phased array system having a plurality of antenna elements is provided. The method includes providing a baseband signal, baseband phase shifting the baseband signal to provide a plurality of baseband shifted signals for controlling phase of each of the plurality of antenna elements, upconverting each of the baseband shifted signals to a radio frequency signal, and applying each of the radio frequency signals to the plurality of antenna elements to thereby provide for spatial control of the phased array system. A hardware architecture for a phased array system is also provided.

19 Claims, 13 Drawing Sheets

PHASED ARRAY SYSTEM USING BASEBAND PHASE SHIFTING

FIELD OF THE INVENTION

The present invention relates to a phased array antenna system, and more particularly to a method and system for spatial control of a phased array antenna system.

BACKGROUND OF THE INVENTION

Phased array antenna systems have many applications in wireless, especially MIMO (multiple inputs and multiple outputs) communication. By using multiple antennas to transmit and receive the signal, the transmit rate is pushed closer towards the channel capacity limit while simultaneously improving security.

Another application of such a system is in sensor array networks where information from a single sensor can be collected or transmitted to a specific receiver by steering the antenna in the right direction. Since the transmitted signal is steered to a specific receiver and nulled in other directions, the security of the signal is improved. A phased array antenna system can be utilized by the military to transmit and receive secure information. A phased array antenna system also has applications in mobile LANs, adaptive dynamic array processing for antennas and automotive radars for collision control, path/lane control, etc.

However, problems remain with phased array antenna systems. Of particular concern is accurate adjustability of the phase and amplitude characteristics for each element of a phased array. Therefore what is needed is an improved method and system for spatial control of a phased array antenna system.

BRIEF SUMMARY OF THE INVENTION

According to one aspect of the present invention, a method of spatial control of a phased array system having a plurality of antenna elements is provided. The method includes providing a baseband signal, baseband phase shifting the baseband signal to provide a plurality of baseband shifted signals for controlling phase of each of the plurality of antenna elements, upconverting each of the baseband shifted signals to a radio frequency signal, and applying each of the radio frequency signals to the plurality of antenna elements to thereby provide for spatial control of the phased array system.

According to another aspect of the present invention, a phased array system is provided. The phased array system includes a plurality of integrated antenna elements, a phase adjusting circuit comprising active phase shifters adapted to provide baseband phase shifts in a baseband signal, and an upconverter circuit operatively connected between the phase adjusting circuit and the plurality of integrated antenna elements and adapted to upconvert the baseband signal to a radio frequency signal.

According to another aspect of the present invention, a phased array system, includes a plurality of integrated antenna elements, a phase detecting circuit adapted to detect baseband phase shifts in a signal, and a downconverter circuit operatively connected between the phase detecting circuit and the plurality of integrated antenna elements and adapted to downconvert the signal.

DETAILED DESCRIPTION OF THE PREFERRED EMBODIMENT

The present phased array antennas are useful for many types of wireless communications. To facilitate description of phased array antennas of the present invention, a discussion regarding theory and modeling is provided, hardware designs are shown, and testing setup and results are provided.

Theory and Modeling

Standard beam formations can be written in terms of the element factor and the array factor as shown $$E_{array}=E_{element}\cdot E_{arrayfactor} \tag{1}$$

Figure 1:
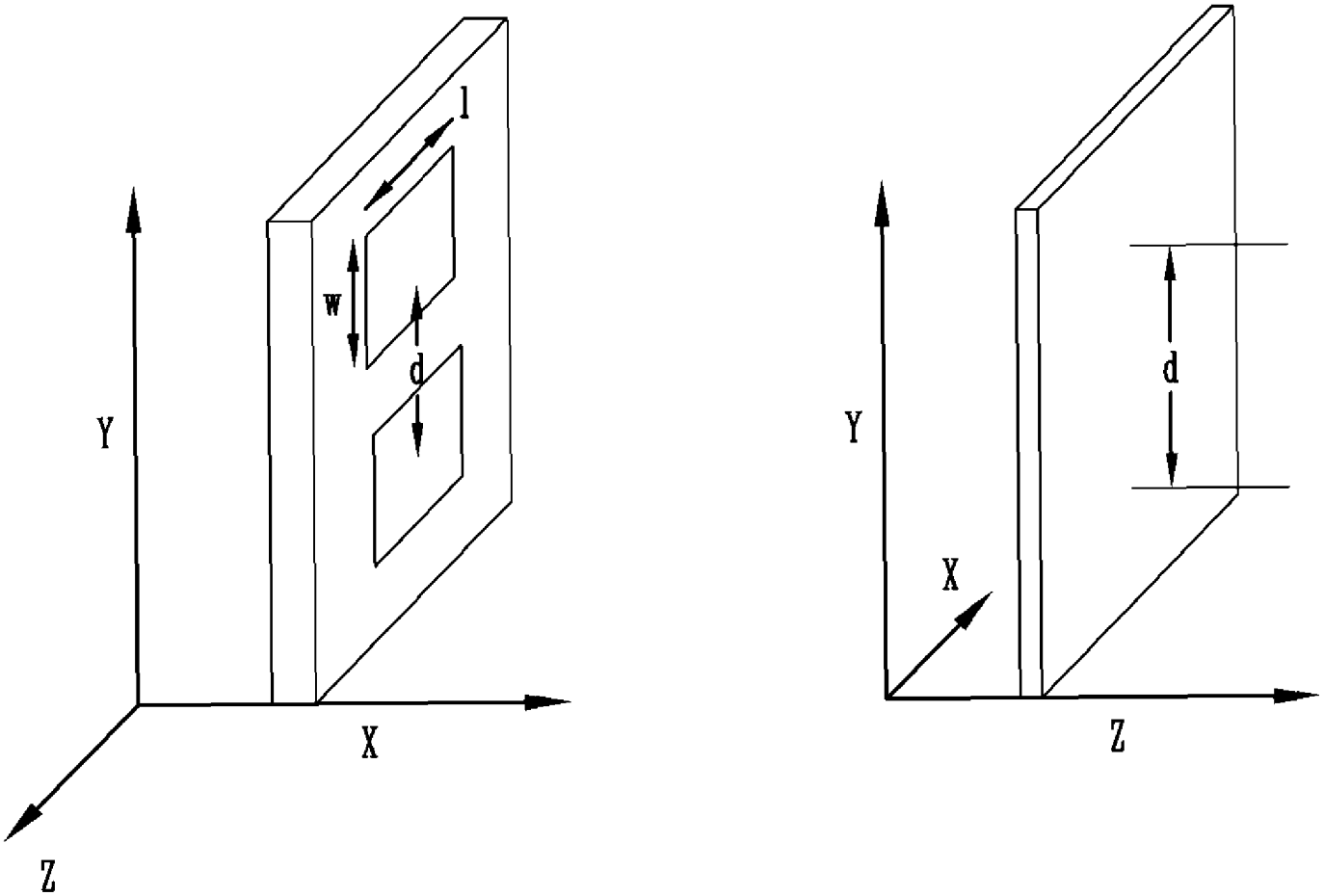
FIG. 1 illustrates a Microstrip and a Dipole Array at an operating frequency of 2.425 GHz. The Dipole Array has a length of 1203 mils and spaced 1155 mils apart. Microstrip Array has a length of 1270 mils, width of 1453 mil, probe feed at position 730 mils by 420 mils on each patch, and patches are spaced 310 mils apart.

This assumption ignores the fact that there is mutual coupling. Eq. 2 and 3 show the standard field pattern for a two element dipole and microstrip array as shown in FIG. 1.

$$E_{dipole}^{H-plane} = E_0\cos[(k_0 d\sin\phi + \beta)/2] \tag{2}$$

$$E_{microstrip}^{E-plane} = E_0[(k_0 h/2)\cos\phi]\cos[(k_0 L/2)\sin\phi]\cos[(k_0 d\sin\phi + \beta)/2] \tag{3}$$

where $k_0=2\pi/\lambda_0$, $\beta$ are the free space wave number and phase difference of the excitation at the antenna, respectively [1].

Scanning Angle

An important aspect of a phased array antenna is the ability to steer the main beam in the direction containing the line of sight, thus reducing multi-path fading, which can be described by the Rician distribution [2]. As shown in [3], the main beam of an antenna can be steered by controlling the phases of the current on the elements as shown $$\frac{I_v}{I_0} = \left|\frac{I_v}{I_0}\right| e^{-jk_0 \vec{r}_v \cdot \vec{p}} \tag{4}$$

where, $$\vec{p} = \sin\phi_0 \cos\phi_0 \hat{a}_x + \sin\theta_0 \hat{a}_y + \cos\theta_0 \hat{a}_z, \tag{5}$$

and $(\theta_0, \phi_0)$ are the scanning angles in spherical coordinates. It can then be shown in [3] that grating lobes can appear at angles $$\sin(\theta_{gl}) = \sin\theta_0 + \frac{P_{gl}\lambda}{D_x} \tag{6}$$

$$P_{Gl} = \pm 1, 2\ldots \text{ with } |\sin\theta_{gl}| \leq 1,$$

where $\theta_{gl}$, is the angle that the grating lobes appear and $D_x$ is the element spacing.

Modeling

Figure 2:
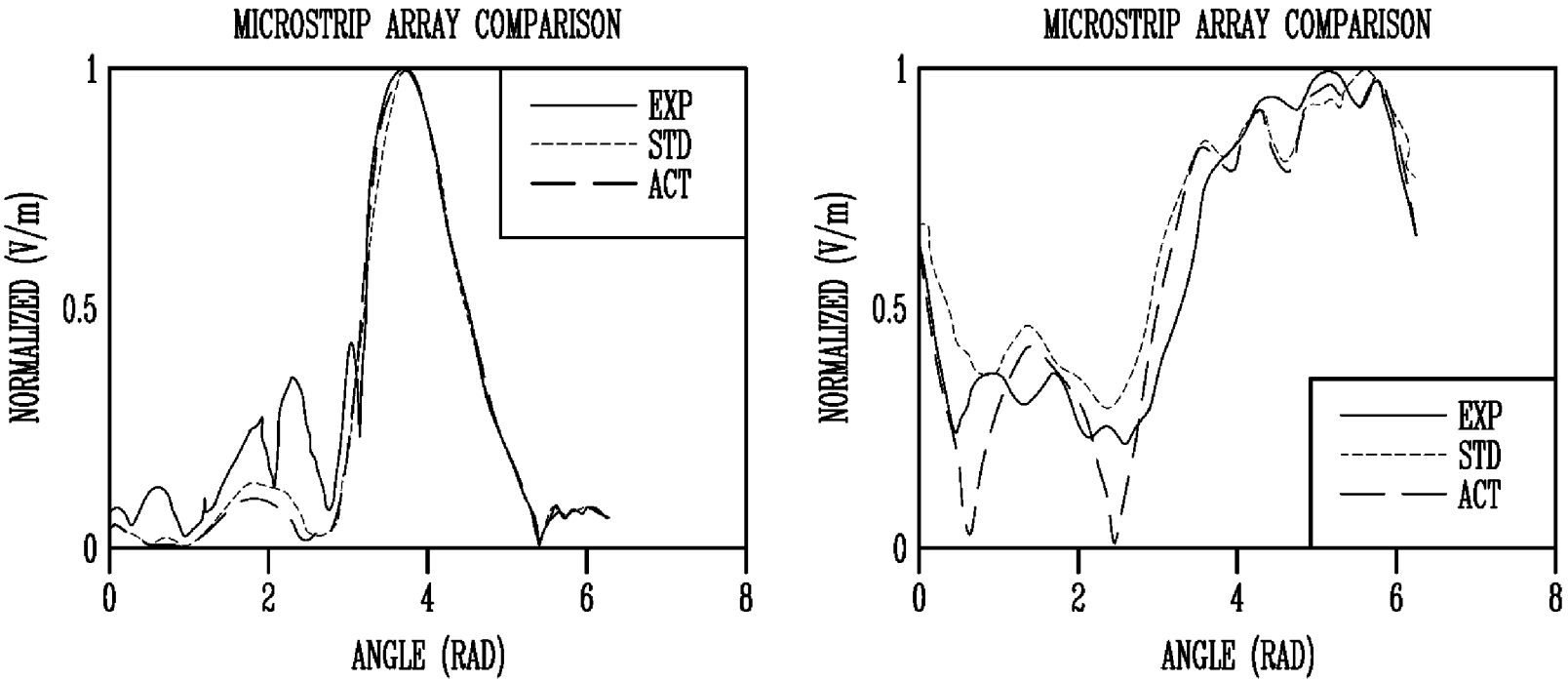
FIG. 2 provides graphs showing a comparison of experimental versus standard and active impedance corrected results for a microstrip and Dipole antenna, respectively [5].

Mutual coupling effects to a first order approximation can be described in terms of an active reflection coefficient which effects are shown in FIG. 2 and written as $$\Gamma_1 = \frac{V_{refl}}{V_{trans}} = \frac{C_1 S_{11} + C_2 S_{12}}{C_1} = S_{11} + \frac{C_2}{C_1} S_{12} \tag{7}$$

$$\Gamma_2 = \frac{V_{refl}}{V_{trans}} = \frac{C_2 S22 + C_1 S_{21}}{C_2} = S_{22} + \frac{C_1}{C_2} S_{21} \tag{8}$$

The field pattern can then be described in terms of forward and backward traveling waves $$E_{\phi} \propto E_{element} \begin{bmatrix} (C_1 + C_1 S_{12}) e^{j(kd/2)\sin\phi} \\ + (C_2 + C_2 S_{22} + C_1 S_{21}) e^{j(-kd/2)\sin\phi} \end{bmatrix}, \tag{9}$$

where the excitation can be described in terms of the phase and voltage at the input terminals of the antenna written as $$C_1 = V_1 e^{j\phi_1} \; C_2 = V_2 e^{k\phi_2}, \tag{10}$$

Figure 3:
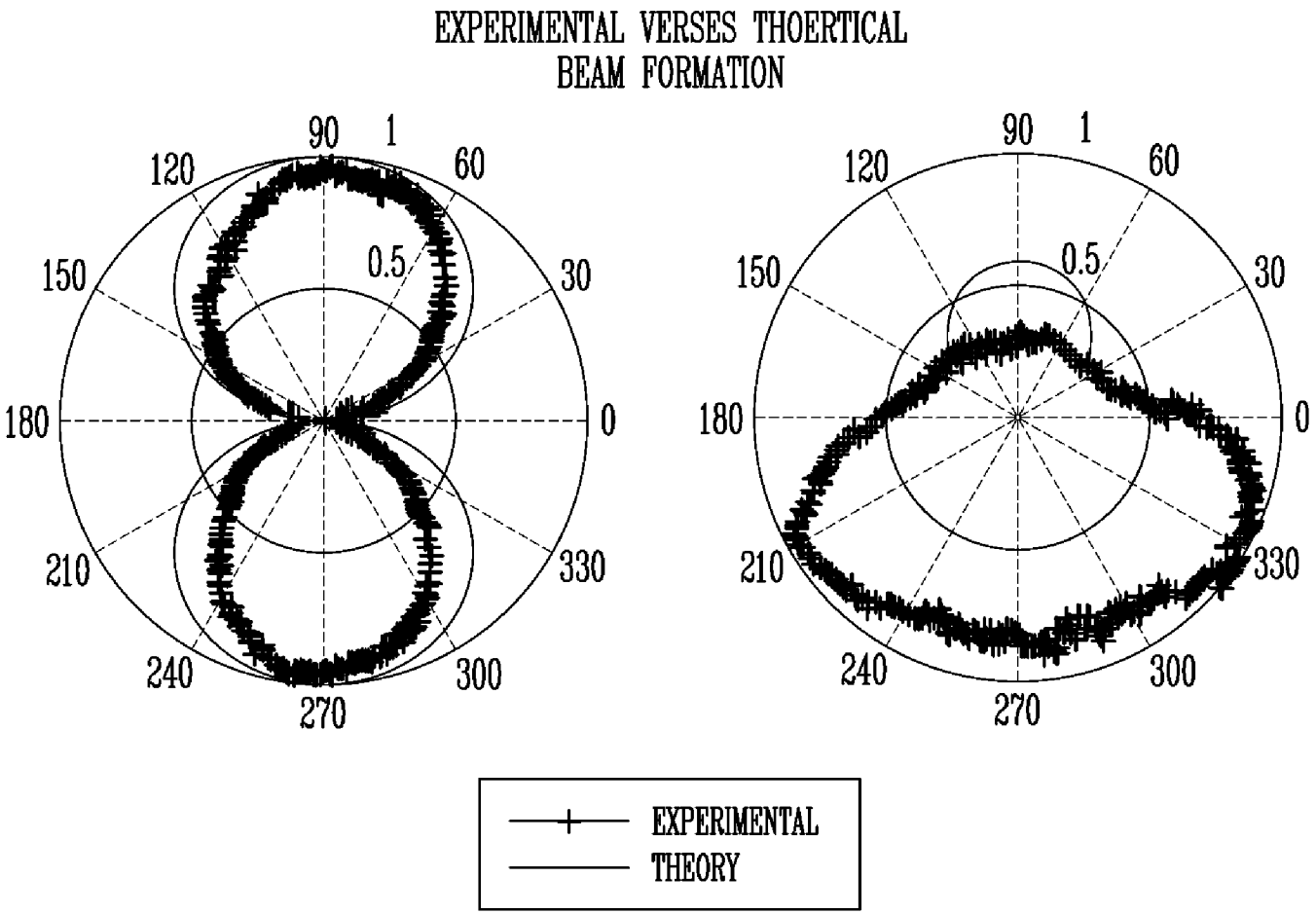
FIG. 3 is a polar E-field plot for the field pattern verses theoretical plot including mutual coupling effects, shifted at two different angles using the automatic phase shifter shown in FIG. 4.

FIG. 2 shows there is a difference between the experimental and the theoretical patterns. The most noticeable differences in the field patterns can be seen in lower levels of the field pattern or null locations. Improvements are found when the active impedance is taken into account. This can be attributed to the domination of the coupling parameters at null locations. FIG. 3 shows the results for scanning at two different angles, including mutual coupling effects.

Hardware Design

Figure 4:
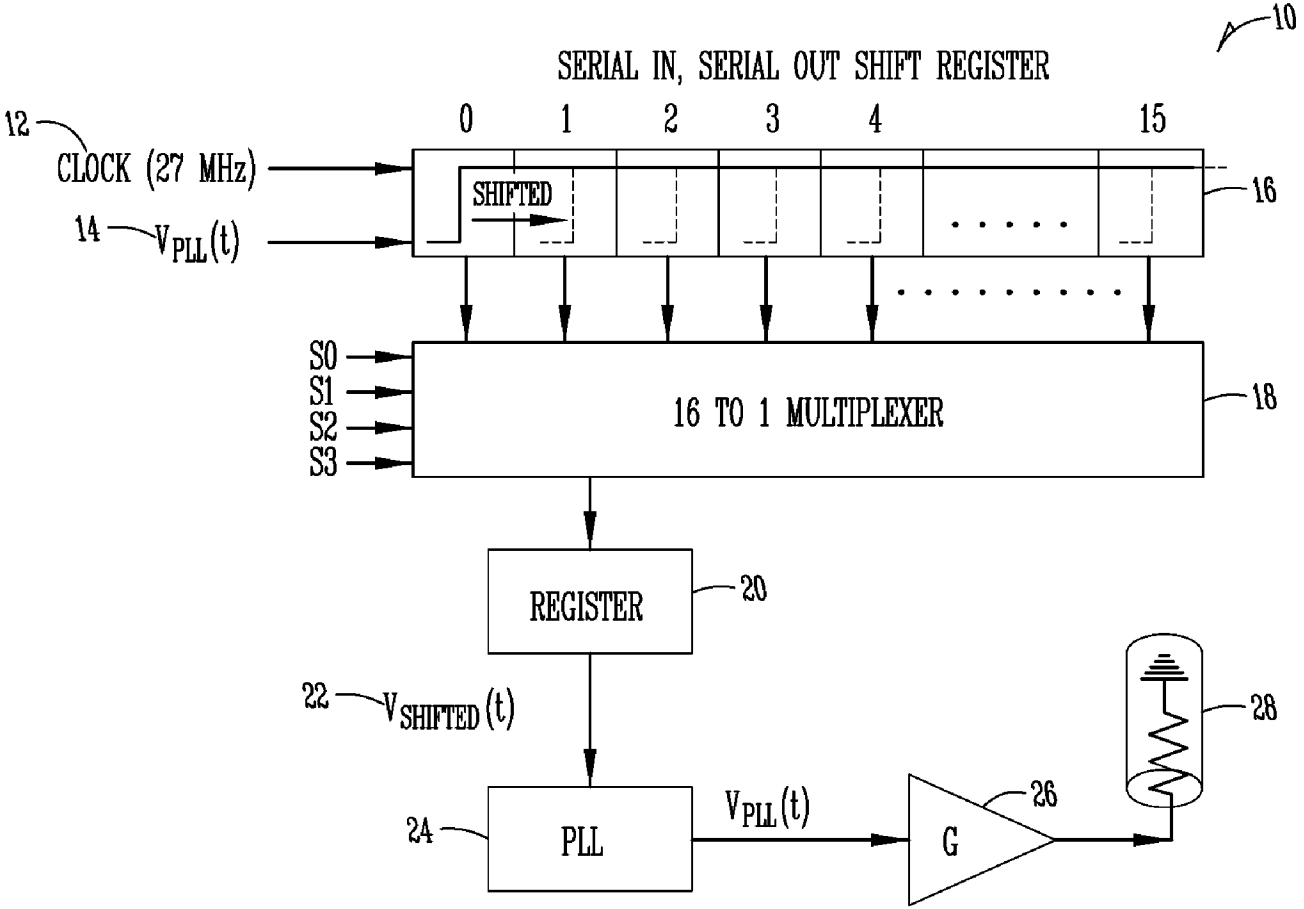
FIG. 4 illustrates a variable delay frequency synthesizer at 2.425 GHz.

A single element hardware setup for a variable phase shifter can be seen in FIG. 4. In FIG. 4, the variable phase shifter 10 includes a serial in, serial out shift register 16 which receives as input a reference clock 12 and feedback signal 14, $V_{PLL}(t)$. A 16 to 1 multiplexer 18 is electrically connected to the shift register 16. A register 20 is electrically connected to the multiplexer 18. A shifted output signal, $V_{SHIFTED}(t)$ is provided into the phase locked loop 24. The output, $V_{PLL}(t)$ is provided to an amplifier 26 which is electrically connected to an antenna element 28.

Figure 5A:
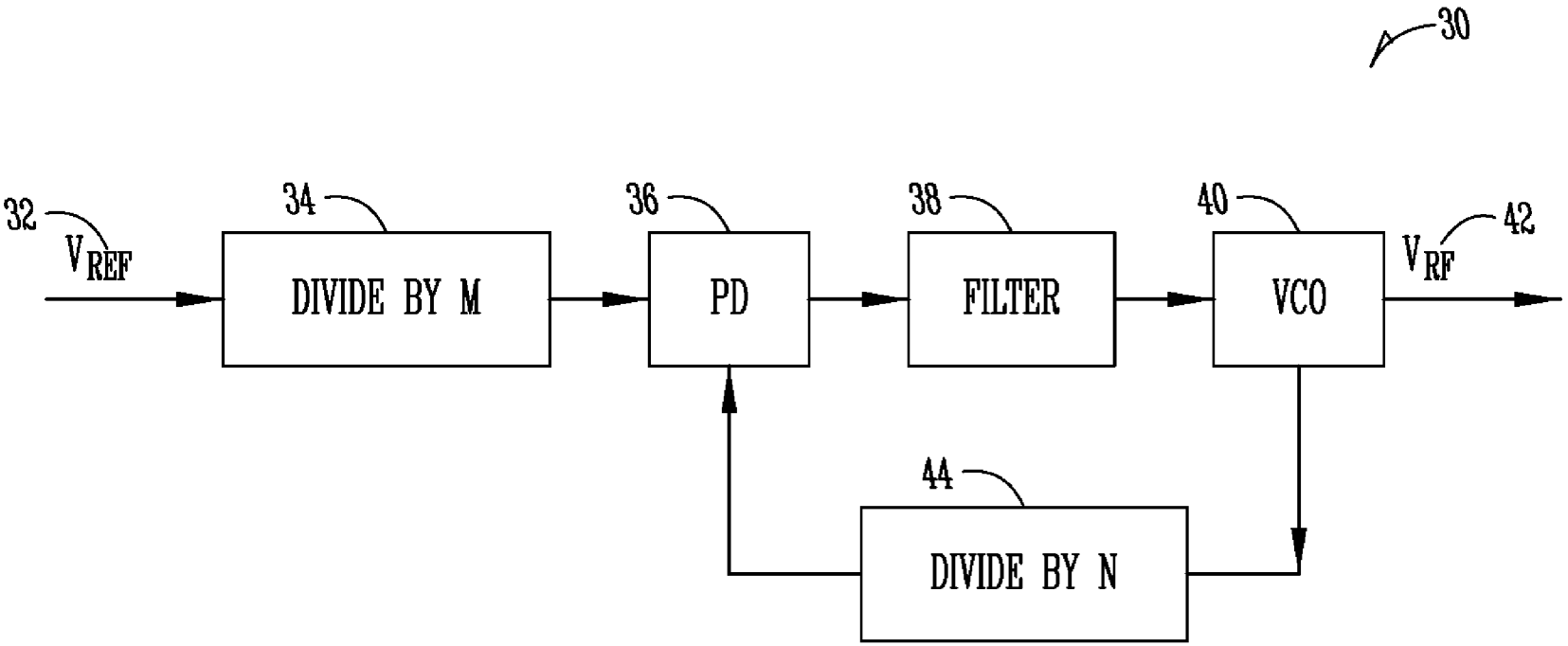
FIG. 5A is a block diagram of a phase locked loop with a digital divider.
Figure 5B:
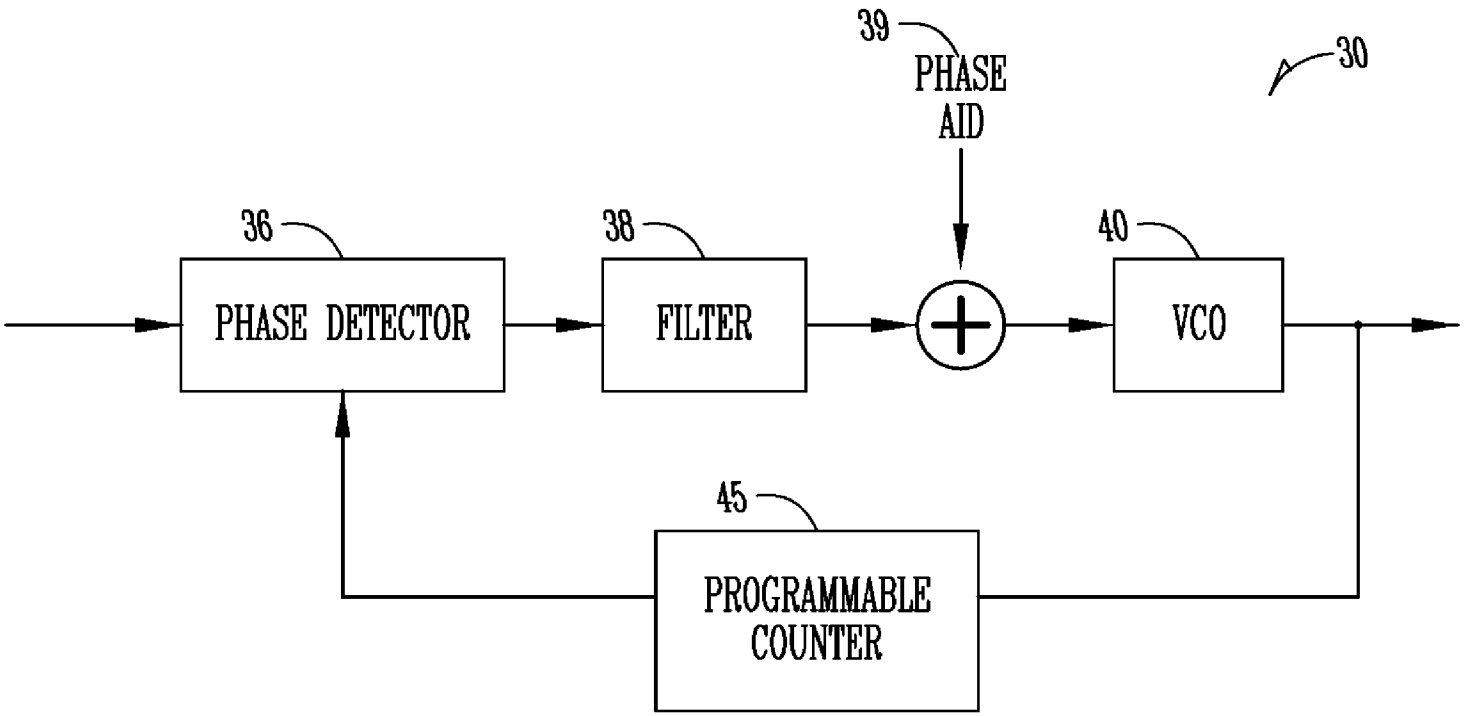
FIG. 5B is a block diagram of a phase locked loop which uses a phase aid.

The reference clock is divided down by 16 to provide a data source and is represented as $$V_{ref}(t) = \frac{\pi}{4} \sum_{l=1,3,5,\ldots}^{\infty} \frac{1}{l} \sin\left(\frac{l\pi t}{L}\right), \tag{11}$$

where L is half the time period. The shift registers are shifted at the clock rate. The shift register contains 16 different delayed versions, sampled on the rising edge of the clock, as shown in Eq. 12.

$$V_{shifted}(t, i) = \frac{\pi}{4} \sum_{l=1,3,5,\ldots}^{\infty} \frac{1}{l} \sin\left(l\omega_0 t + \frac{2\pi i}{16}\right) \tag{12}$$

for i=1, 2, . . . , 16 [6]. The pll (phase locked loop) locks into phase with the shifted data and provides a 2.425 GHz source and is represented as $$V_{pll,p}(t,i) = B_p \sin(\omega_{rf} t + \phi_0^p), \tag{13}$$

where, $$\phi_0^p = \frac{n}{m} \frac{2\pi i}{16} + \phi_{loopdelay} \tag{14}$$

for i=1, 2, . . . , 16 where m and n are the frequency divide ratios of the reference and RF signal of the phase locked loop respectively as which is shown in FIG. 5A. As shown in FIG. 5A, a reference signal $V_{REF}$ is provided to a divide by M counter 34 which is electrically connected to a phase detector 36, the output of which is electrically connected to a filter 38. The filter 38 is electrically connected to a voltage controlled oscillator (VCO) 40 which provides an output signal, $V_{RF}$. Feedback is provided from the VCO 40, through the divide by N counter 44 back to the phase detector 36. FIG. 5B illustrates an alternative phase locked loop which introduces a phase aid into the phase locked loop to reduce the transient time needed for convergence by introducing a transient which, when in combination with the original response, produces a pseudo convergence of the loop. In FIG. 5B, a phase detector 36 is electrically connected to a filter 38. The output from the filter 18 is combined with a phase aid 39 to provide an input to the VCO 40. Feedback from the VCO 40 is used as input to a programmable counter 45 which is electrically connected to an input of the phase detector 36.

Figure 6:
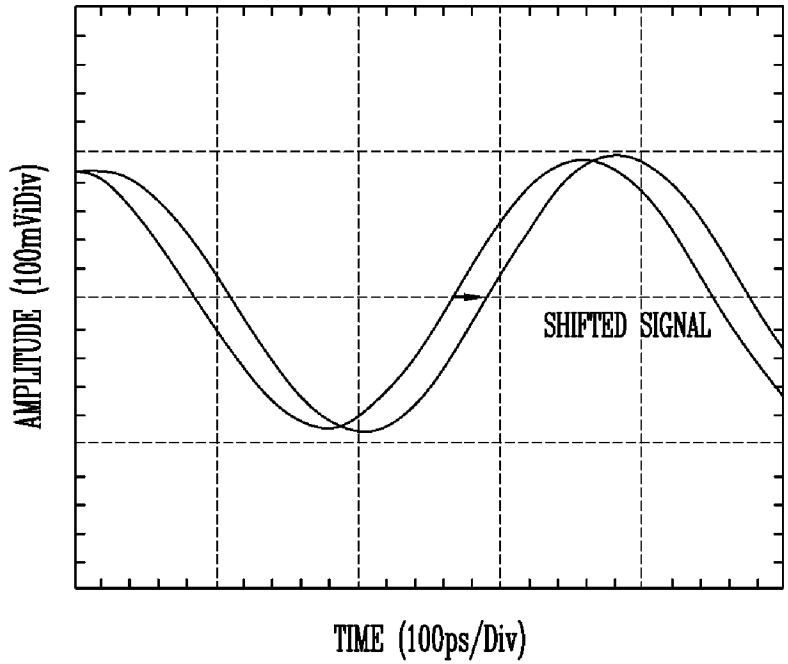
FIG. 6 is the signal shifted at baseband operation and at RF at two different types of delays.
Figure 6:
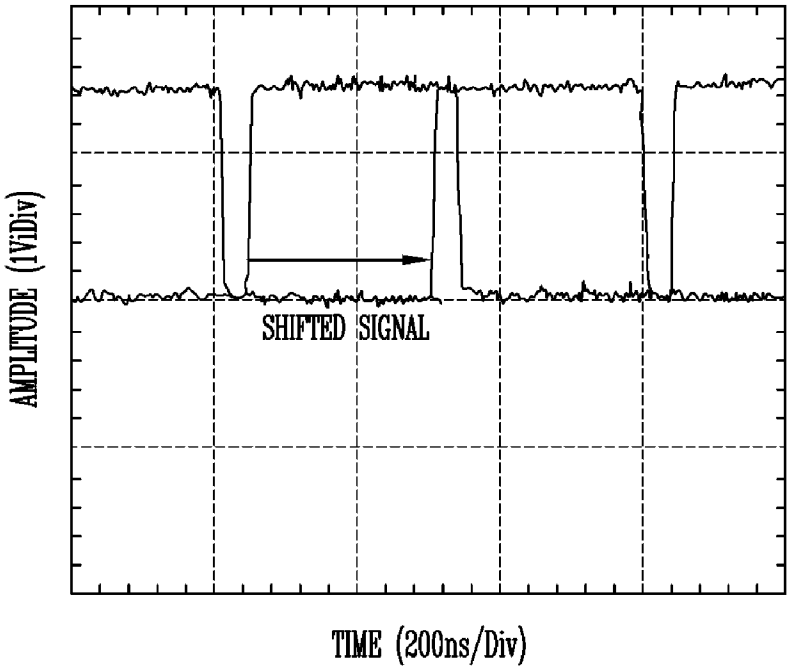
Figure 7:
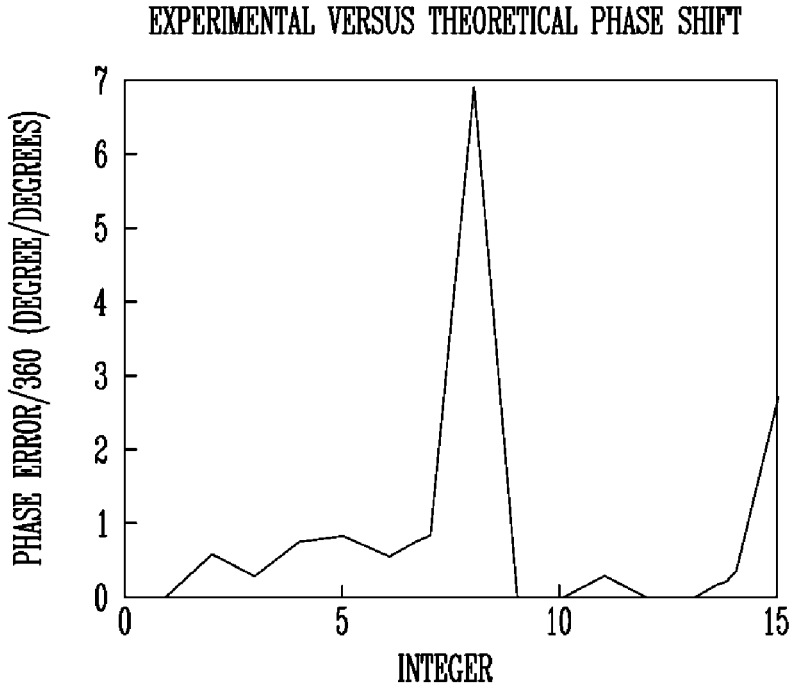
FIG. 7 is an experimental phase error for a phase locked loop using digital dividers with a reference frequency of 3.125 MHz and 2.425 GHz.
Figure 8:
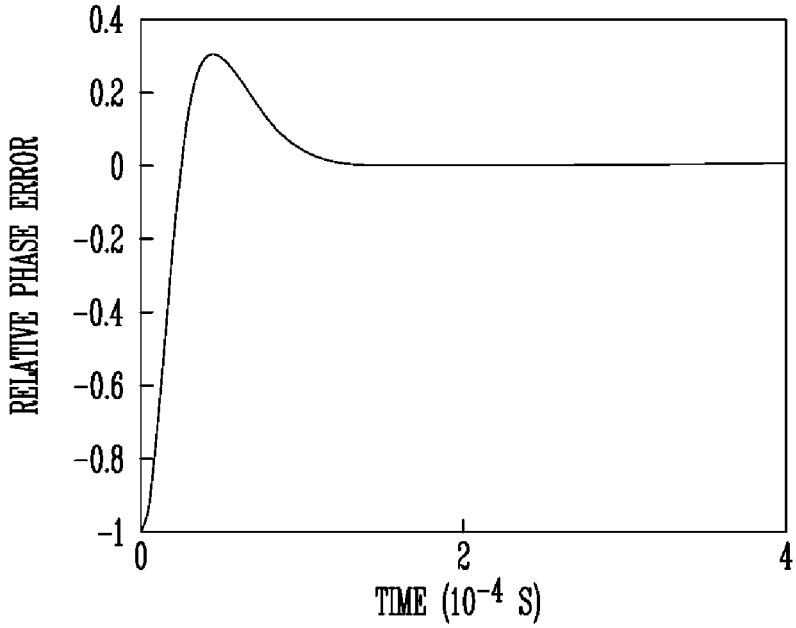
FIG. 8 is a simulated phase error plot for the PLL unit step phase response [5].

The delayed versions of the baseband signal and the RF signal can be seen in FIG. 6. The division ratio produces a scaled version of the phase offset. The accuracy of Eq. 14 can be seen in FIG. 7 which shows reasonable agreement with experimental results. The anomaly at integer 8 can be explained by a cycle slip of the registers. Scaling can be minimized or eliminated by using a frequency offset phase locked loop. In order to help ensure stability and zero steady state phase error during phase hops, a loop filter resulting in a third order loop was chosen [7]. However, other loop configurations could also be used for which these conditions are governing considerations. The settling time of the phase locked loop can be seen in FIG. 8. The signal is sent to a power amplifier whose desired load impedance is matched to the inactive input impedance of the antenna terminals. The input signal can be represented as $$V_{antenna,p}(t,i) = C_p \sin(\omega_{rf} t + \phi_o^p) \tag{15}$$

It will be shown that the phased array pattern is independent of a given modulation scheme. For example, a QPSK modulation scheme can be described in terms of the following excitation per symbol.

$$\overline{A}^{p}_{baseband} = A_p \sin\left[w_{baseband} t + (i-1)\frac{\pi}{2} + \phi_0^p\right] \tag{16}$$

for i=1, 2, 3, 4 and the excitation coefficients at the antenna terminals can be represented as $$\overline{C}^{P}_{RF} = C_{mod} C_p e^{j[(i-1)\frac{\pi}{2} + \phi_0^p]} \tag{17}$$

Figure 9:
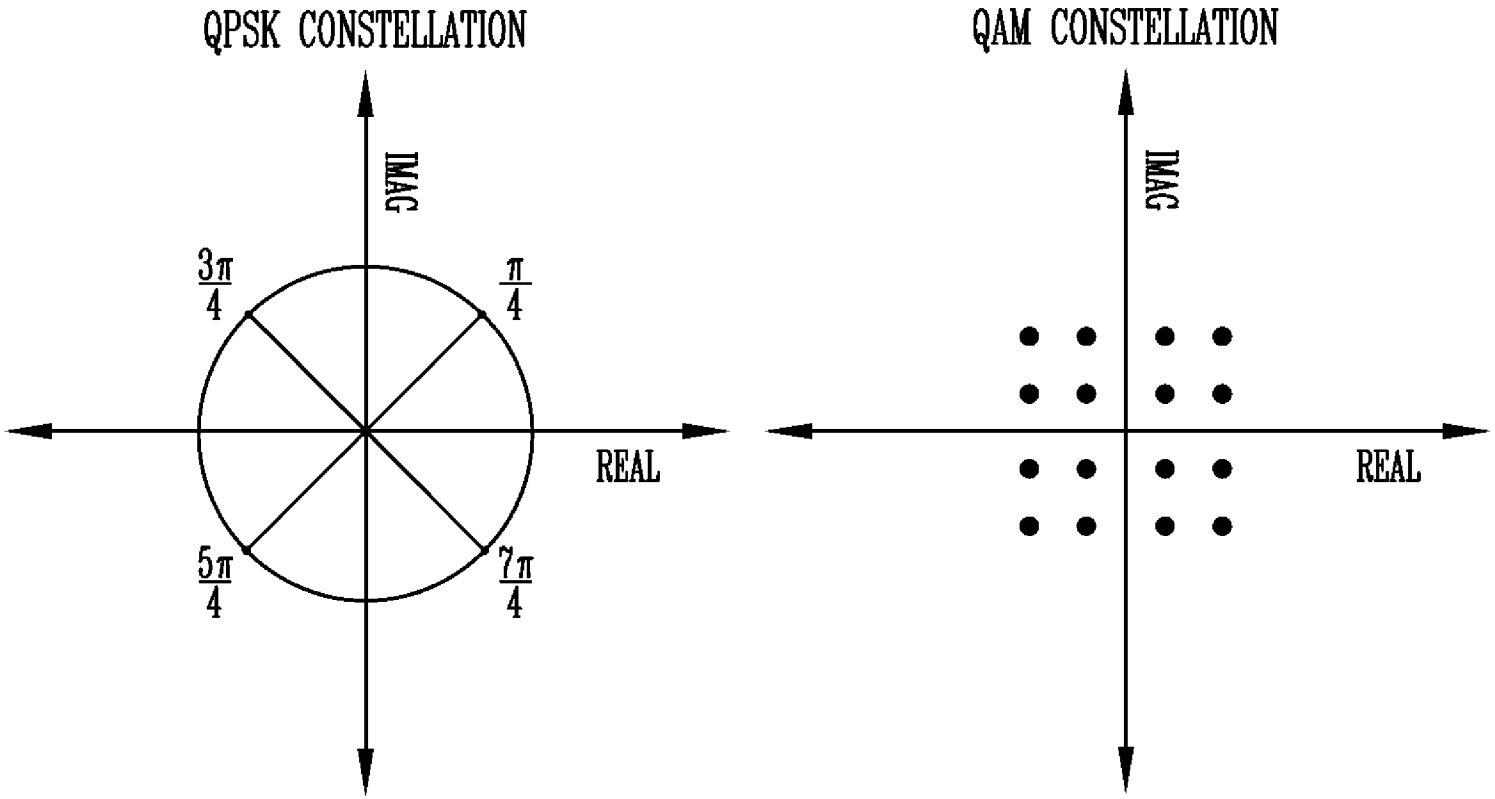
FIG. 9 is a quadrature phase shifting keying and quadrature amplitude modulation communication scheme.

Inserting the excitation into Eq. 9, and after factoring, the field pattern can be written as $$E_\phi = \left\{ \begin{array}{c} E_{element}[(C_1 + C_{11} + C_2 S_{12}) e^{j(kd/2)\sin\phi}] \\ +(C_2 + C_2 S_{22} + C_1 S_{21}) e^{j(-kd/2)\sin\phi} \end{array} \right\} C_{mod} e^{j\left[(i-1)\frac{k}{2}\right]}, \tag{18}$$

which is independent of the modulation angle. This can be generalized to any modulation scheme. The architecture presented is best suitable for QAM and QPSK modulations which are shown in FIG. 9. This architecture is suitable for high data rate transmission due to its ability to support QAM and QPSK modulation types.

Test Setup

Figure 10:
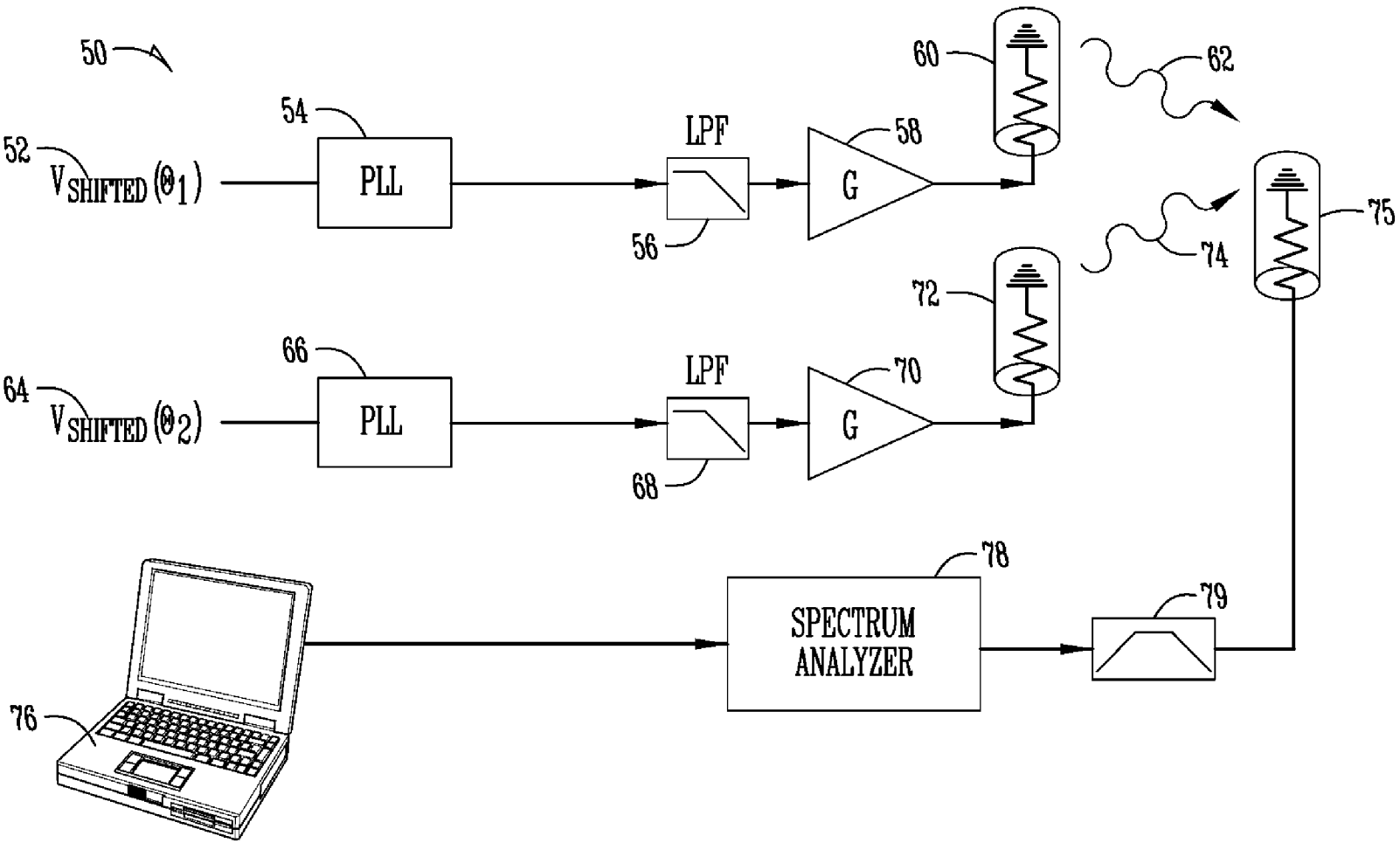
FIG. 10 is a simulated phase error plot for the PLL unit step phase response.

FIG. 10, shows an automated setup 50 for power versus angle measurements. The spectrum analyzer 78 is connected to a computer 76, which synchronizes the machine to an angular rotary device. As shown in FIG. 10, a $V_{SHIFTED}(\theta_1)$ signal 52 is input into a first PLL 54. The PLL 54 is electrically connected to a low pass filter 56, which is electrically connected to an amplifier 58 which is electrically connected to an antenna element 60 which transmits a radio frequency signal 62. Similarly, a $V_{SHIFTED}(\theta_2)$ signal 64 is input into a second PLL 66 which is electrically connected to a low pass filter 68 which is electrically connected to an amplifier 70 which is electrically connected to another antenna element 72 which transmits a radio frequency signal 74 to a receive antenna 75 which is electrically connected to a bandpass filter 79 which is electrically connected to a spectrum analyzer 78 connected to the computer 76.

The spectrum analyzer is configured for narrow band measurements that are averaged to reduce measurement variation by the square root of the average factor. The reduction in variation allows for low side lobe measurements to be performed. The exact phase differences between the input signals were measured using an oscilloscope and these signals can be described by the equation below $$V_1(t) = C_1 \sin(\omega_{rf} t + \phi_1), \tag{19}$$

and, $$V_2(t) = C_2 \sin(\omega_{rf} t + \phi_2) \tag{20}$$

Using Eq. 19 and 20 and scattering parameter measurement results of the amplifier, filter, and interconnecting cables one obtains $$V_{p,antenna}(t) = C_{p,antenna} \sin(\omega_{rf} t + \phi_{p,antenna}) \tag{21}$$

where $$C_{p,antenna} = C_{p,filter} C_{p,amp} C_{p,cable} B_p \tag{22}$$

and $$\phi_{p,antenna} = \phi_{p,cable} + \phi_{p,amp} + \phi_0^p \tag{23}$$

The scattering parameters of the array are directly measured and combined with Eq. 9 to predict field pattern measurements.

Figure 11:
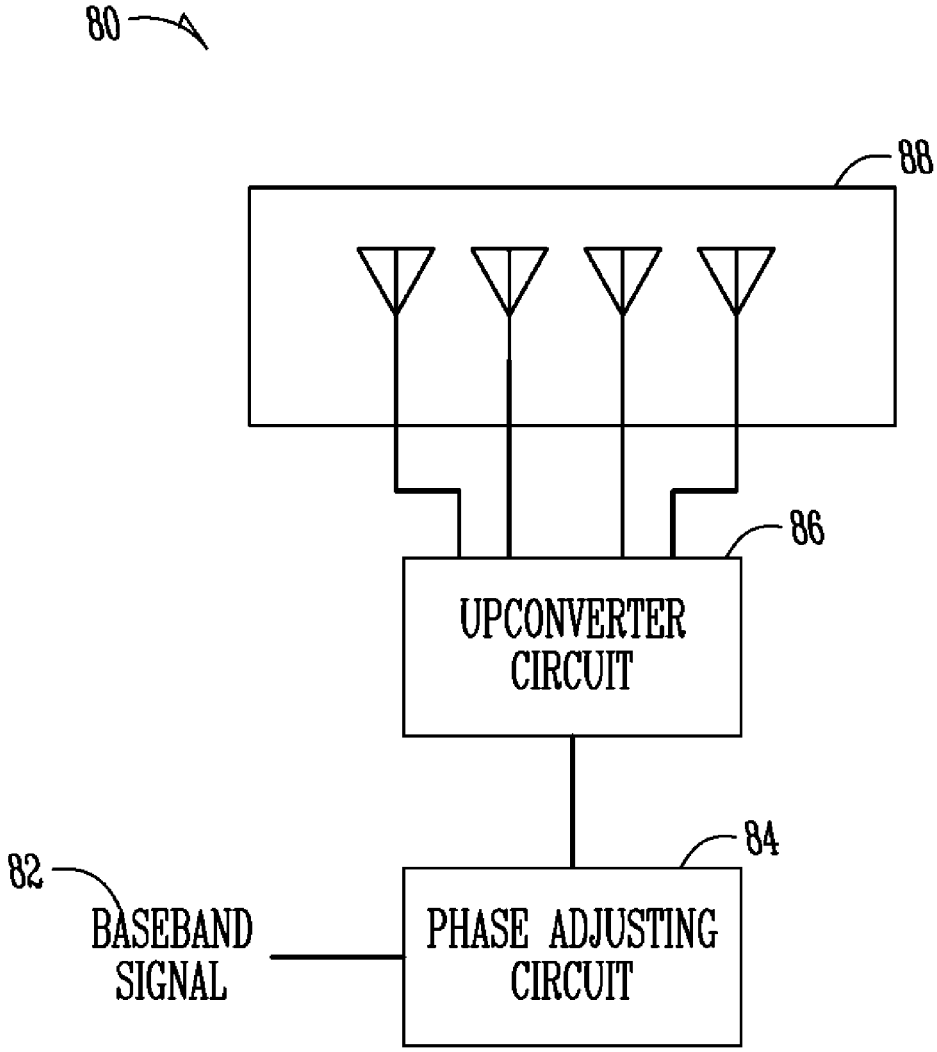
FIG. 11 is a block diagram of one embodiment of a system.

FIG. 11 provides a simplified block diagram of the present invention. A system 80 is shown which includes a phased array antenna 88 which is electrically connected to an upconverter circuit 86 which is electrically connected to a phase adjusting circuit 84. In operation, the baseband signal 82 is phase shifted by the phase adjusting circuit 84. The resulting signals are then upconverted with the upconverter circuit 86 and communicated to the phased array antenna 88.

The phase array system disclosed describes a transmitting system but a receiving system or a transmitting/receiving system of similar architectures can be readily assembled by those of ordinary skill in the art using the same techniques for steering the array. In a receiving system, the upconverter, for example 86 of FIG. 11 would become a down-converter, the output amplifiers, for example 58 and 70 of FIG. 10, would become low noise amplifiers with gain in the receive direction, and the phase adjusting circuit, for example, 84 of FIG. 11 would become a phase detecting circuit. Those of ordinary skill in the art would know that for a transmitting/receiving system a diplexer/duplexer could become redundant but in general a diplexer/duplexer would be used in a full transmitting/receiving system.

Figure 12:
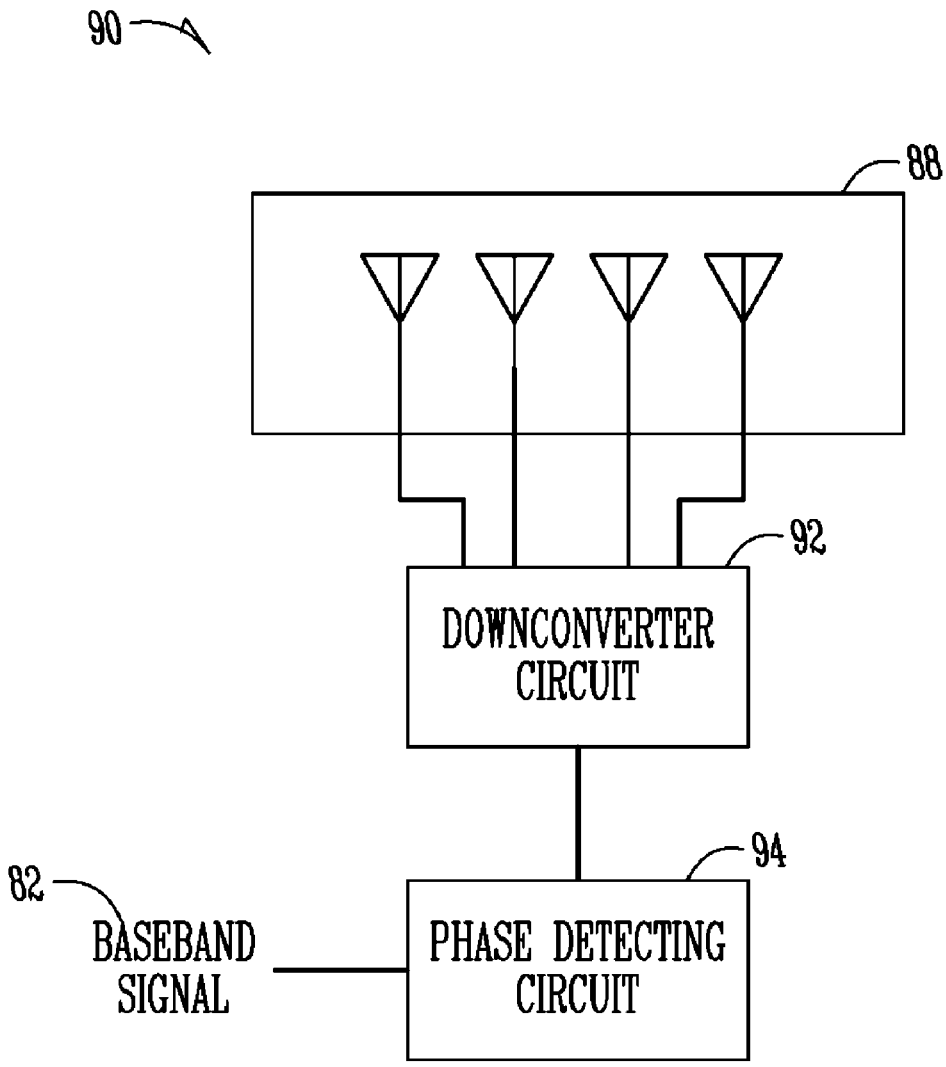
FIG. 12 is a block diagram of a receive system.

FIG. 12 provides a simplified block diagram of the present invention for a receiving system. A system 90 is shown which includes a phased array antenna 88 which is electrically connected to a downconverter circuit 92 which is electrically connected to a phase detecting circuit 94. In operation, signals are communicated from the phased array antenna 88 to the downconverter circuit 92. Phase detection is performed by the phase detecting circuit 94.

Figure 13:
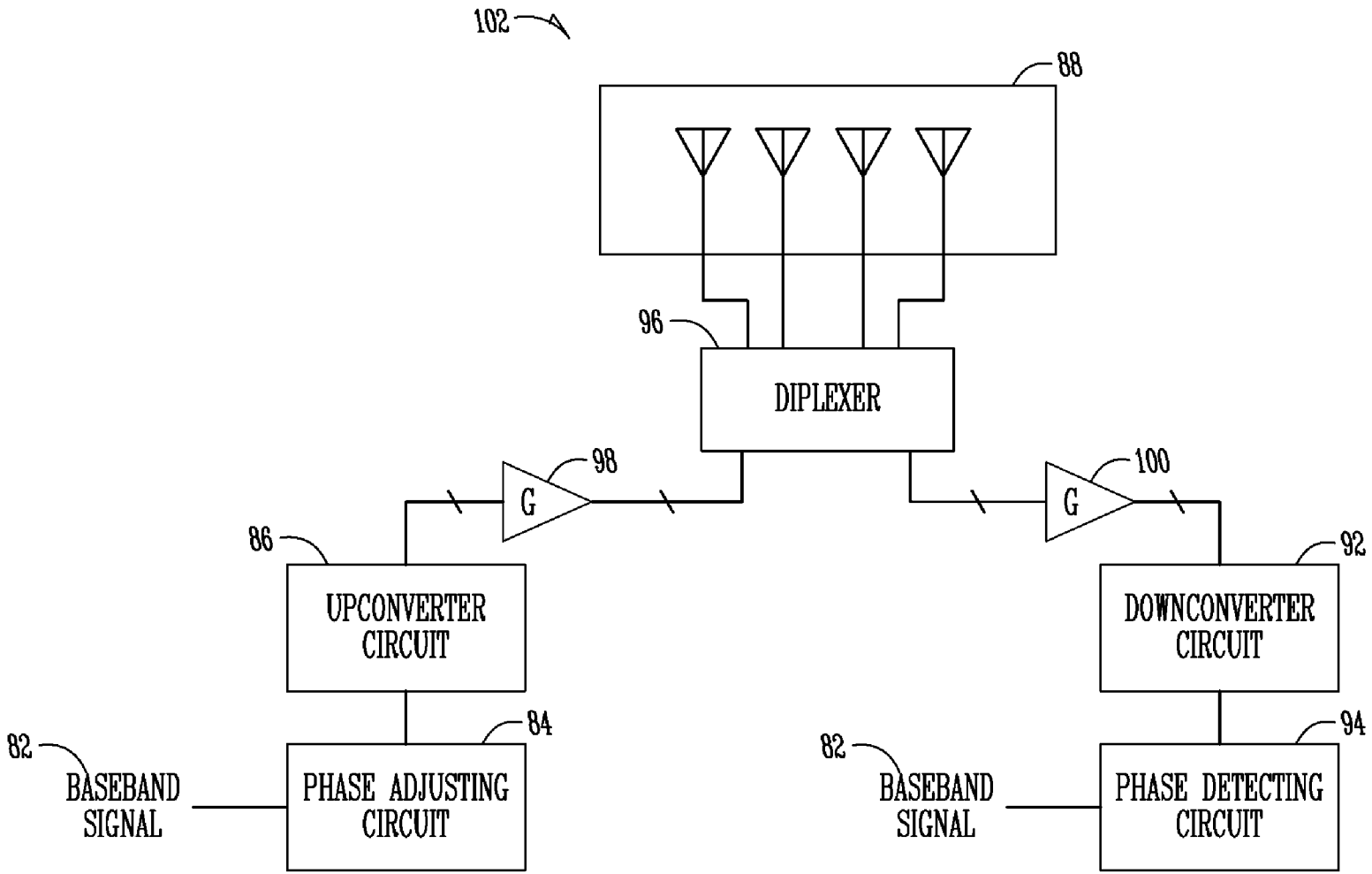
FIG. 13 is a block diagram of a transmitting/receiving system.

FIG. 13 provides a simplified block diagram of a transmitting/receiving system 102. In FIG. 13, a diplexer 96 is electrically connected to the phased array antenna 88. The diplexer 96 directs the transmitted signal from the transmit path and the received signal to the receive path. In the transmitting path, the baseband signal 82 is provided to the phase adjusting circuit 84 which is electrically connected to the upconverter circuit 86. An output amplifier 98 is shown which is electrically connected to the diplexer 96. On the receive side, the diplexer 96 is electrically connected to amplifier 100 which is a low noise amplifier. The amplifier 100 is electrically connected to the downcoverter circuit 92 which is electrically connected to the phase detecting circuit 94.

Therefore, a method and system for a phased array antenna system has been disclosed, modeling methods to accurately predict beam formation have been described and a 2.425 GHz phased array architecture for automatic beam steering has been shown as well as suitable modulation techniques and an automated test setup with experimental techniques. The present invention contemplates numerous variations in the specific frequencies used, although of particular interest is frequencies above 1 GHz and preferably above 2 GHz; the type of antennas used for transmitting and receiving; the type of modulation used; and other variations, options, and alternatives.

It is also apparent to those of ordinary skill in the art that phase shift at a frequency is related to time delay of a signal as:

$$\text{time delay} = \frac{1}{360}\frac{\text{phase delay} - deg\ rees}{\text{frequency} - \text{hertz}}$$

such that when this disclosure speaks of phase shift or phase delay it could also speak of time shift or time delay.

It is to be understood that the embodiments described herein are merely illustrative of the many possible specific arrangements that can be devised in application of the principles of the invention. Other arrangements can be devised in accordance with these principles by those of ordinary skill in the art without departing from the scope and spirit of the invention. It is therefore intended that such other arrangements be included within the scope of the following claims and their equivalents.

REFERENCES

All of the references cited in herein are hereby incorporated by reference in their entireties.

[1] Balanis c., "Antenna Theory, Analysis and Design," Wiley Interscience, pp. 816-843, 2005.

[2] Molisch, Andreas F., "Wireless Communications," John Wiley and sons, pp. 80, July 2006.

[3] Weisbcck, Ing., "Lecture notes to Introduction to Microstrip Antennas," University Karlsruhe pp. 58, 2001.

[4] D. M. Pozar, "The Active Element Pattern," *IEEE Transactions on Antennas and Propagation*, vol. 42, no. 8, August 1994.

[5] Wanner, Shannon, Weber, Robert 1., Song, Jiming, "Mutual Coupling in Phase Array", Antennas and Propagation-Society, 2007

[6] Egen, William, "Phase Locked Basics," Wiley Interscience, pp. 249, 1998.

[7] Donald R. Stephens, Phase-Locked Loops for Wireless Communications: Digital, Analog and Optical Implementations, Kluwer Academic Publishers, 2nd edition, 2001.

What is claimed is:

1. A method of spatial control of a phased array system having a plurality of antenna elements, the method comprising:

providing a baseband signal;

baseband phase shifting the baseband signal to provide a plurality of baseband shifted signals for controlling phase of each of the plurality of antenna elements;

upconverting each of the baseband shifted signals to a radio frequency signal;

applying each of the radio frequency signals to the plurality of antenna elements to thereby provide for the spatial control of the phased array system.

2. The method of claim 1 wherein the baseband phase shifting is performed using active phase shifters.

3. The method of claim 1 further comprising controlling amplitude of each of the radio frequency signals.

4. The method of claim 1 further comprising transmitting each of the radio frequency signals with the phased array antenna system.

5. The method of claim 2 wherein each of the active phase shifters comprises a shift register.

6. The method of claim 2 wherein each of the active phase shifters further comprises a phase locked loop.

7. The method of claim 6 wherein each of the active phase shifters comprises an adjustable amplifier.

8. The method of claim 7 wherein each of the active phase shifters further comprises an offset phase locked loop.

9. The method of claim 6 wherein the phase locked loop is adapted for receiving a phase aid to increase speed.

10. The method of claim 1 wherein the radio frequency signal being greater than 2 GHz.

11. A phased array system, comprising:

a plurality of integrated antenna elements;

a phase adjusting circuit comprising active phase shifters adapted to provide baseband phase shifts in a baseband signal, the active phase shifters comprising phase locked loops configured to receive a phase aid to increase speed;

an upconverter circuit operatively connected between the phase adjusting circuit and the plurality of integrated antenna elements and adapted to upconvert the baseband signal to a radio frequency signal.

12. The phased array system of claim 11 wherein the phase locked loops comprise an offset phase locked loop.

13. The phased array system of claim 11 wherein the radio frequency signal being greater than 2 GHz.

14. The phased array system of claim 11 further comprising a diplexer operatively connected to the plurality of integrated antenna elements and wherein the upconverter circuit being operatively connected to the diplexer.

15. The phased array system of claim 14 further comprising a downconverter circuit operatively connected to the diplexer and a phase detecting circuit operatively connected to the downconverter circuit.

16. The phased array system of claim 15 further comprising an output amplifier between the upconverter circuit and the diplexer and a low noise amplifier between the diplexer and the downconverter circuit.

17. A method of spatial control of a phased array system having a plurality of antenna elements, the method comprising:

providing a baseband signal;

baseband phase shifting the baseband signal, the step of baseband phase shifting comprising (a) using a variable phase shifter to provide a plurality of baseband shifted signals for controlling phase of each of the plurality of antenna elements, wherein each of the variable phase shifters comprises a phased lock loop, (b) providing a phase aid to each of the phased lock loops;

upconverting each of the baseband shifted signals to a radio frequency signal;

applying each of the radio frequency signals to the plurality of antenna elements to thereby provide for the spatial control of the phased array system.

18. A phased array system, comprising:

a plurality of integrated antenna elements;

for each of the integrated antenna elements, (a) a serial in, serial out shift register electrically connected to receive as input a reference clock signal and a phased lock loop feedback signal, (b) a multiplexer electrically connected to the shift register, (c) a register electrically connected to the multiplexer, (d) a phased lock loop electrically connected to the multiplexer, an output of the phase lock loop electrically connected to the shift register to provide the phased lock loop feedback signal, (e) an amplifier electrically connected to the output of each of the phased lock loops, (f) an output of the amplifier electrically connected as input to one of the integrated antenna elements.

19. The phased arrays system of claim 18 further comprising a phase aid input electrically connected to the phased lock loop for each of the integrated antenna elements.

* * * * *